United States Patent [19]

Baker

[11] Patent Number: 4,528,818

[45] Date of Patent: Jul. 16, 1985

[54] SEQUENCING MEANS FOR STIRLING CYCLE, ERICSSON CYCLE OR LIKE APPARATUS

[75] Inventor: M. J. Baker, Hatfield, England

[73] Assignee: British Aerospace Public Limited Company, London, England

[21] Appl. No.: 508,105

[22] Filed: Jun. 27, 1983

[30] Foreign Application Priority Data

Jun. 30, 1982 [GB] United Kingdom ..... 8218924

[51] Int. Cl.[3] ..... F25B 9/00

[52] U.S. Cl. ..... 62/6; 60/520

[58] Field of Search ..... 62/6; 60/520

[56] References Cited

U.S. PATENT DOCUMENTS 3,913,339 10/1975 Berry ..... 62/6
3,991,586 11/1976 Acord ..... 62/6
4,090,858 5/1978 Hanson ..... 62/6
4,409,793 10/1983 Durenec ..... 62/6
4,412,423 11/1983 Durenec ..... 62/6

FOREIGN PATENT DOCUMENTS 2012886 1/1979 United Kingdom .

*Primary Examiner*—Ronald C. Capossela
*Attorney, Agent, or Firm*—Cushman, Darby & Cushman

[57] ABSTRACT

In Stirling Cycle or similar apparatus having a compressor (15, 15*a*), a cold finger (1) and a displacer (4) within the cold finger, sequencing between the compressor and the displacer is effected by a piston (7) effecting displacement of the displacer in response to pressure variations in the compressor (15, 15*a*) and a combination of piston valves (9, 10) and one-way valves (12, 14) preventing flow between the compressor (15*a*) and the cold finger (1) until desired displacements of the displacer (4) have been effected.

1 Claim, 6 Drawing Figures

SEQUENCING MEANS FOR STIRLING CYCLE, ERICSSON CYCLE OR LIKE APPARATUS

Figure 1:
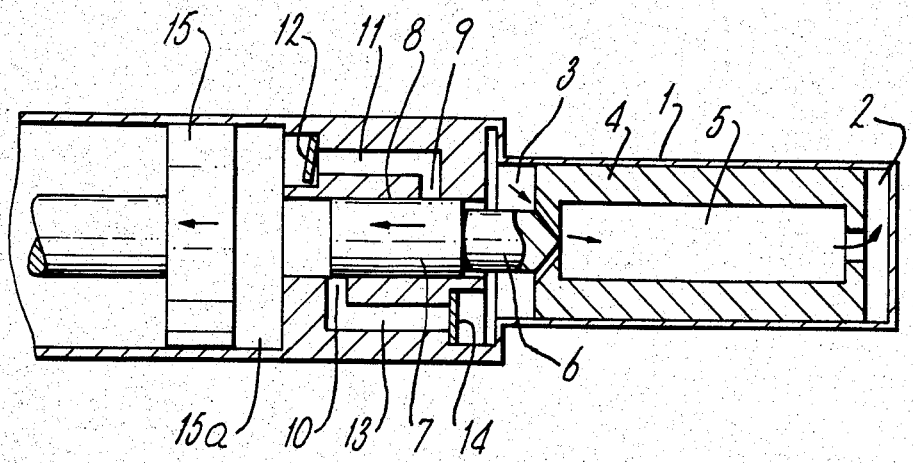

This invention relates to sequencing means for Stirling Cycle, Ericsson Cycle, or like apparatus in which a working fluid is contained in first and second chambers, the first chamber having working means associated therewith for sequentially effecting compression or expansion of the working fluid, displacer means forming first and second zones within the second chamber, flow connection means interconnecting the first chamber and the first zone of the second chamber, and sequencing means for effecting movement of the displacer means so as to vary the volumes of the two zones and thereby move the working fluid between the two.

In some arrangements, for example U.K. Pat. No. 2,012,886, a mechanical arrangement has been used to effect correct sequencing between the working means and the displacer means. In other arrangements, such as U.S. Pat. No. 3,991,586, there is no such mechanical interconnection, fluid pressure being used to effect displacement of the displacer means. Unless it is used only at resonant frequencies, this arrangement requires other means, for example the sensors and solenoids disclosed in U.S. Pat. No. 3,991,586, to effect correct sequencing.

The present invention specifically relates to apparatus in which fluid pressure is used to effect displacement of the displacer means but has, additionally, the objective of providing sequencing means using only working fluid pressure changes with no requirement for complicated mechanisms or power sources.

According to the present invention, Stirling cycle, Ericsson cycle, or similar apparatus having a working fluid, first and second chambers within which the working fluid is contained, working means associated with the first chamber for effecting sequential compression or expansion of the working fluid, displacer means forming first and second zones within the second chamber, flow connection means interconnecting the first chamber and the first zone of the second chamber, and sequencing means for effecting movement of the displacer means, so as to vary the volumes of the two zones and thereby move the working fluid between the two zones, the sequencing means including actuation means for effecting movement of the displacer means in response to pressure variations in the first chamber and valve means in the flow connection means preventing flow between the first and second chambers until desired displacements of the displacer means have been effected.

Preferably, the actuation means for effecting movement of the displacer means comprises a piston connected to the displacer means acted upon by the working fluids in both the first and the second chambers.

In this case, the flow connection means comprises feed duct means and return duct means, each providing a flow path between the first and second chambers, and the valve means comprise, in the feed duct means, one-way valve means arranged to always prevent flow from the second to the first chamber, and port means closed by the piston except when the first zone is at or near maximum volume, and in the return duct means, one-way valve means arranged to always prevent flow from the first to the second chamber, and port means closed by the piston when the second zone is at or near maximum volume, whereby, with a low pressure state in the first chamber and both the feed and return duct means closed, compression of the working fluid in the first chamber causes a pressure differential which effects movement of the displacer means towards the second zone of the second chamber, at or near minimum volume of the second zone the feed duct means opens so that continued compression in the first chamber causes flow into the first zone of the second chamber, subsequent expansion in the first chamber with both the feed and return ducts closed, causes a pressure differential which effects movement of the displacer means toward the first zone, and, at or near minimum volume of the first zone, the return duct means opens so that continued expansion in the first chamber causes a flow of working fluid from the second zone, via the first zone into the first chamber, and sequentially thereafter.

Figure 4:
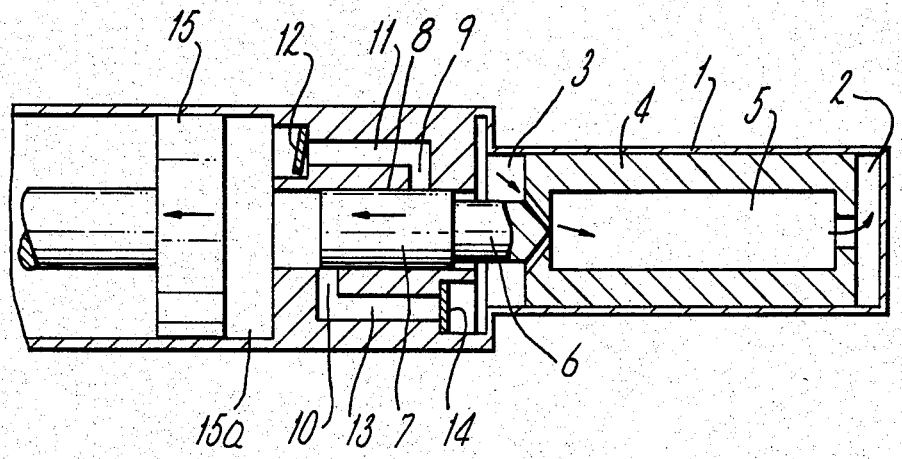
Figure 5:
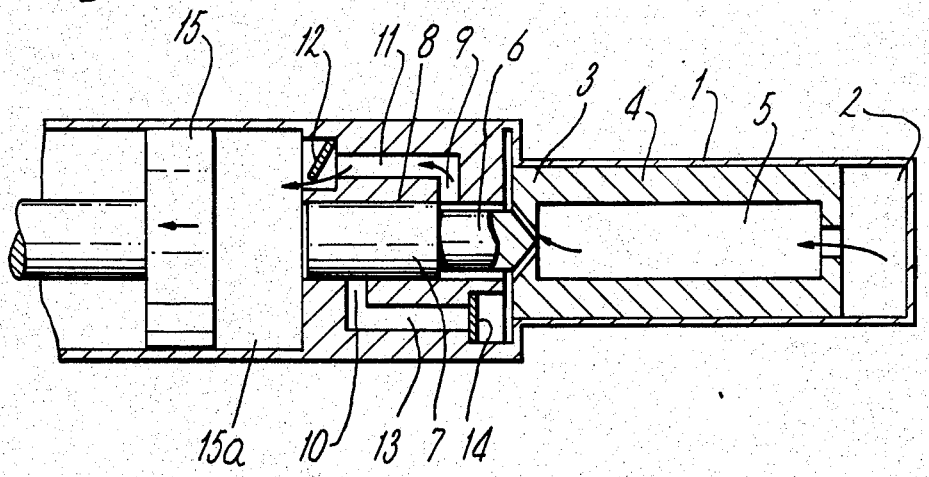
Figure 6:
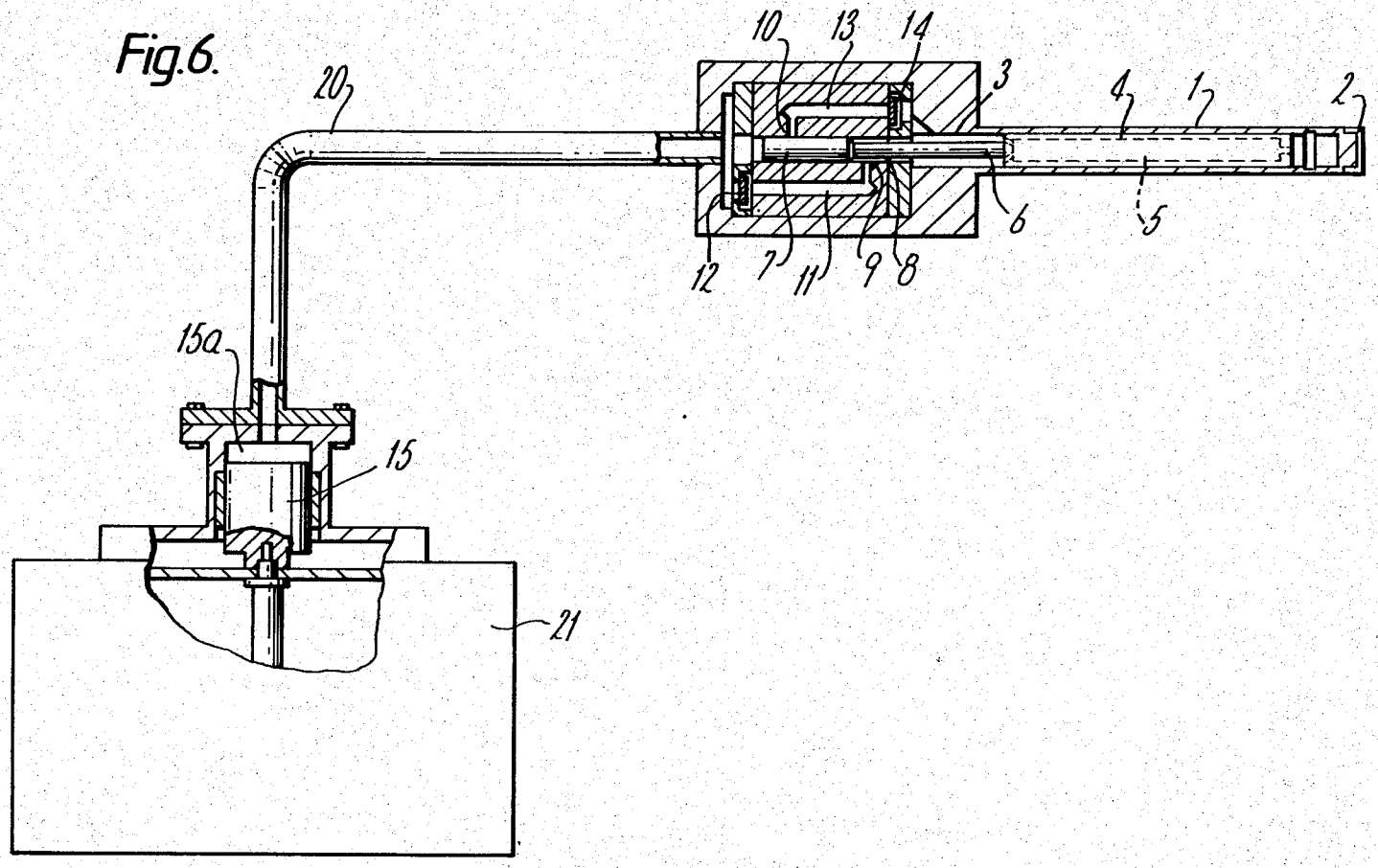

The invention is described by way of example with reference to the accompanying drawings in which:

FIG. 1 is a diagrammatic cross-sectional representation of Stirling cycle apparatus, as applied to cooling apparatus, FIGS. 2 to 5 are similar elevations of the apparatus in sequential conditions, and, FIG. 6 is a diagrammatic cross-sectional representation of an alternative embodiment, again for use in cooling apparatus.

Referring initially to FIG. 1, the apparatus consists of a cold finger 1 (said second chamber means) containing a cold end region 2 (said second zone) and a hot end region 3 (said first zone) separated by a displacer 4 which in turn contains a re-generator 5. Movement of the displacer 4 from one end of the finger to the other causes working fluid to be displaced from one end to the other through the re-generator 5. Such movement of the displacer 4 is effected by connecting it via a piston rod 6 to a piston 7. The piston 7 slides in a bore 8 and is arranged to be acted upon by working fluid pressure in a compressor chamber 15*a* (the said first chamber means). The compressing element (said working means) in this embodiment is shown as a piston 15, but it can be any other means such as a diaphragm or a bellows.

Flow connection means including valve means provide flow connection between the chamber 15*a* and the hot end region 3 of the finger 1 and are in the form of two sets of ports 9 and 10 formed in the bore 8. These ports are arranged such that ports 9 are closed by the piston 7 except when the displacer is substantially at the hot end of the cold finger, and ports 10 are closed by the piston 7 except when the displacer is substantially at the cold end of the cold finger. Ports 9 communicate via return ducts 11 with one-way valves 12. These one-way valves 12 are arranged so that they will allow working fluid to flow from the cold finger but will not allow fluid to flow into the cold finger. Ports 10 communicate via feed ducts 13 with one-way valves 14. These one-way valves 14 are arranged such that they will allow fluid to flow into the cold finger but will not allow fluid to flow from the cold finger.

Conveniently, for the purposes of illustration, the feed and return ducts and their associated elements are shown singly. They may, for design purposes, be duplicated or otherwise pluralised.

The behaviour of the apparatus during a typical cycle is described with reference to FIGS. 2–5.

Whilst this apparatus will start satisfactorily from any combination of positions of displacer 4 and drive piston 15, for convenience it is assumed that initially the displacer 4 is at the hot end of the cold finger and that the drive piston 15 is fully withdrawn so as to create a low fluid pressure.

Figure 2:
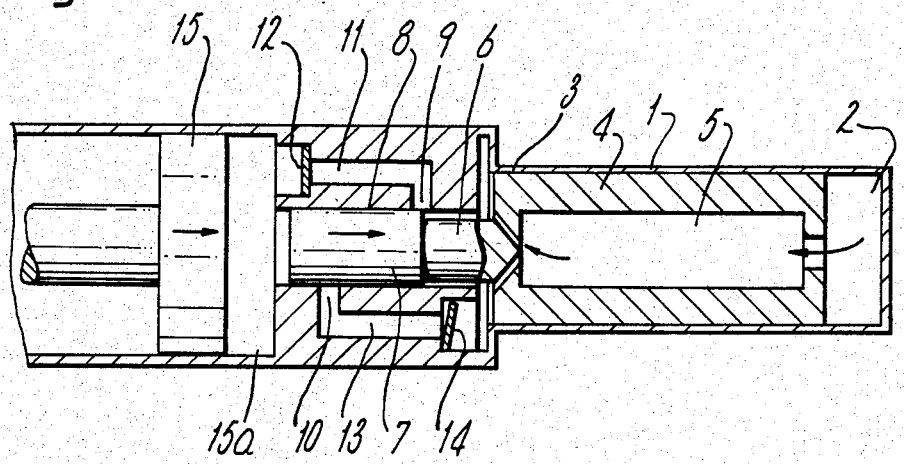

In FIG. 2 the piston 15 is moved from the withdrawn position so as to compress the working fluid. Since ports 10 are blocked by piston 7 and one-way valves 12 will not allow fluid flow into the cold finger, then the fluid trapped in the cold finger will not undergo any immediate pressure increase Therefore, a pressure difference will be created across piston 7 producing a force that causes it to move such that the displacer 4 is pushed towards the cold end of the cold finger. This movement will cause some pressure rise in the fluid in the cold finger, partly because the mean bulk temperature of the fluid in the cold finger will rise as fluid is forced through the re-generator 5 from the cold end 2 into the hot end 3 and partly because the piston 7 must have some finite area. In a well designed machine, this pressure rise will be substantially less than the rise in pressure in chamber 15*a* caused by compression movement of the piston 15.

Figure 3:
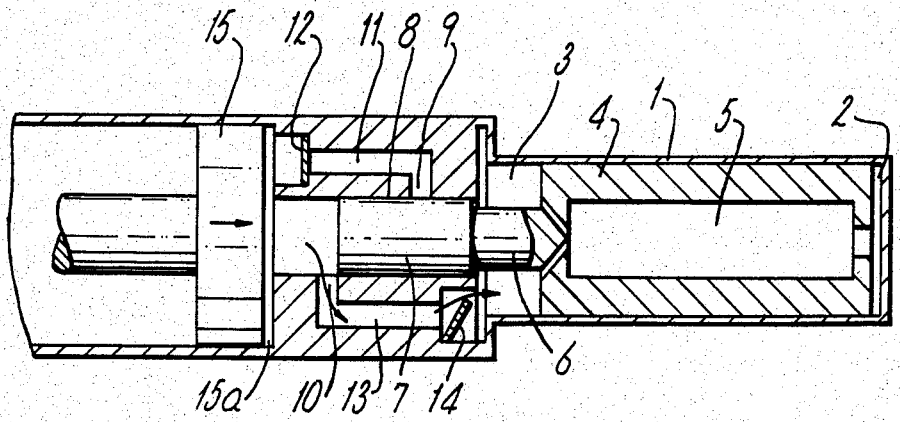

When the displacer is substantially at the cold end of the cold finger, as shown in FIG. 3, the piston 7 will have opened ports 10 and will allow relatively high pressure fluid to flow from the chamber 15*a*, through ducts 13 and one-way valves 14 into the cold finger. Thus fluid in the cold finger is compressed. Since, with the displacer at the cold end, most of the fluid in the cold finger is at the hot end, the majority of the heat of compression of the fluid in the cold finger will be evolved at the hot end of the cold finger and a substantial part of that heat will be conducted away from the fluid by heat transfer means not shown. The drive piston 15 will continue to compress the fluid, forcing a substantial portion of the total fluid mass into the cold finger.

Once the compression process is complete, the drive piston 15 reverses its motion, thus starting to expand the fluid and causing the pressure of the fluid in the chamber 15*a* to drop. However, the piston 7 is blocking ports 9 thus preventing fluid flow out of the cold finger. Therefore, there will be no immediate drop in the pressure of the fluid in the cold finger. Therefore, a pressure difference will be created across the piston 7 in such a direction as to cause it to move and pull the displacer towards the hot end of the cold finger.

FIG. 4 shows this condition with the displacer moving towards the hot end of the cold finger and forcing high pressure fluid to flow from the hot end 3 through the re-generator 5 into the cold end 2. There will be a pressure drop in the cold finger during this process, partly due to the drop in the mean bulk temperature of the fluid in the cold finger and partly due to the fluid area of the piston 7. This pressure drop should be less than the pressure drop in the chamber 15*a*.

When the displacer is substantially at the hot end of the cold finger, as shown in FIG. 5, the piston 7 will open port 9, thus allowing fluid to flow from the cold end of the cold finger, through the re-generator, through ports 9, through ducts 11 and the one-way valves 12 into the chamber 15*a*. This flow will reduce the pressure in the cold finger. Since the majority of the fluid in the cold finger is at the cold end 2, the heat of expansion of the fluid in the cold finger will be substantially evolved at the cold end and will be conducted by external heat transfer means not shown.

The drive piston 15 will continue expanding the fluid in the apparatus until the process is completed. The drive piston will then once more reverse its motion so as to start compressing the fluid. This is the condition shown in FIG. 2 and the cycle description is complete.

Clearly, it is essential that the cycle frequency is not so great that there is insufficient time available for the displacer to complete its stroke. Also, it is essential that the pressure differences generated across piston 7 are sufficient to overcome frictional forces tending to prevent movement of the displacer. Other than these essential requirements, there are no limitations on the way in which such apparatus may be run.

In Ericsson cycle apparatus, the drive piston 15 may be replaced by valve means to effect the cyclic changes in pressure.

In FIG. 6, in which like components are given like reference numerals, the first chamber means and the working means (that is to say the compressor chamber 15*a* and the piston 15) are remote from the second chamber means (that is to say the cold finger 1). In this case, the pressure sensitive actuation means (that is to say the piston 7) is still arranged to be responsive to pressure differentials between the first and second chamber means, but a pressure transmitting connection 20 is provided between the first chamber means and the pressure sensitive actuation means. In this embodiment, the piston 15 is actuated by electromechanical drive means shown generally at 21.

I claim:

1. Stirling cycle, Ericsson cycle, or similar apparatus having a working fluid, first and second chambers (15*a*, 1) within which the working fluid is contained, working means (15) associated with the first chamber (15 *a*) for effecting sequential compression or expansion of the working fluid, displacer means (4) forming first and second zones (3, 2) within the second chamber (1), flow connection means (11, 13) interconnecting the first chamber (15*a*) and the first zone (3) of the second chamber (1), and sequencing means for effecting movement of the displacer means (4), so as to vary the volumes of the two zones (3, 2) and thereby move the working fluid between the two zones, the sequencing means including actuation means (7) for effecting movement of the displacer means in response to pressure variations in the first chamber (15*a*) and valve means (9, 10, 12, 14) in the flow connection means preventing flow between the first (15*a*) and second (1) chambers until desired displacement of the displacer (4) means have been effected, said actuation means for effecting movement of the displacer means comprising a piston (7) connected to the displacer means (4) acted upon by the working fluid in both the first and the second chambers (15*a*, 1), said flow connection means comprising feed duct means (13) and return duct means (11) each providing a flow path between the first (15*a*) and second (1) chambers, and the valve means comprise, in the feed duct means (13), one-way valve means (14) arranged to always prevent flow from the second (1) to the first (15*a*) chamber, and port means (10) closed by the piston (7) except when the first zone (3) is at or near maximum volume, and in the return duct means (11), one-way valve means (12) arranged to always prevent flow from the first (15*a*) to the second (1) chamber, and port means (9) closed by the piston (7) when the second zone (2) is at or near maximum volume, whereby, with a low pressure state in the first chamber (15*a*) and both the feed (13) and return (11) duct means closed, compression of the working fluid in the first chamber (15*a*) causes a pressure differential which effects movement of the displacer means (4) towards the second zone (2) of the second chamber, at or near minimum volume of the second zone (2) the feed duct means (13) opens so that continued compression in the first chamber (15*a*) causes flow into the first zone (3) of the second chamber, subsequent expansion in the first chamber (15*a*) with both the feed (13) and return (11) ducts closed, causes a pressure differential which effects movement of the displacer means (4) toward the first zone (3), and, at or near minimum volume of the first zone (3), the return duct means (11) opens so that continued expansion in the first chamber (15*a*) causes a flow of working fluid from the second zone (2), via the first zone (3) into the first chamber (15*a*), and sequentially thereafter.

* * * * *